US012716373B2

(12) United States Patent
Magherini

(10) Patent No.: US 12,716,373 B2
(45) Date of Patent: Aug. 25, 2026

(54) MUFFLER FOR INTERNAL COMBUSTION ENGINES

(71) Applicant: PIAGGIO & C. S.P.A., Pontedera (IT)

(72) Inventor: Adriano Magherini, Pontedera (IT)

(73) Assignee: PLAGGIO & C. S.P.A., Pontedera (IT)

( * ) Notice: Subject to any disclaimer, the term of this patent is extended or adjusted under 35 U.S.C. 154(b) by 244 days.

(21) Appl. No.: 18/689,487

(22) PCT Filed: Sep. 26, 2022

(86) PCT No.: PCT/IB2022/059116
§ 371 (c)(1),
(2) Date: Mar. 6, 2024

(87) PCT Pub. No.: WO2023/052963
PCT Pub. Date: Apr. 6, 2023

(65) Prior Publication Data

US 2024/0384673 A1 Nov. 21, 2024

(30) Foreign Application Priority Data

Sep. 29, 2021 (IT) ..... 102021000024923

(51) Int. Cl.
*F01N 1/08* (2006.01)

(52) U.S. Cl.
CPC ..... *F01N 1/083* (2013.01); *F01N 1/082* (2013.01); *F01N 2590/04* (2013.01)

(58) Field of Classification Search
CPC ..... F01N 1/163; F01N 1/083; F01N 1/082; F01N 12/1838; F01N 2240/36; F01N 2410/10; F01N 2410/12; F01N 2470/14; F01N 2470/16; F01N 2590/04
USPC ..... 181/226, 238
See application file for complete search history.

(56) References Cited

U.S. PATENT DOCUMENTS 3,972,685 A * 8/1976 Hanaoka ..... F01N 3/2006 60/287
4,913,260 A * 4/1990 Fallon ..... F01N 1/10 181/254
7,895,832 B2 * 3/2011 Gruber ..... F01N 1/083 181/227

(Continued)

FOREIGN PATENT DOCUMENTS

DE 102024126883 A1 * 4/2025 ..... F01N 1/003
EP 2412945 A2 2/2012

(Continued)

*Primary Examiner* — Jeremy A Luks
(74) *Attorney, Agent, or Firm* — McGlew and Tuttle, P.C.

(57) ABSTRACT

A muffler (4) for motor vehicles comprising an intake pipe (8) of the exhaust gases that separates, at a fork (10), into a main pipe (12) and a secondary pipe (16), a muffler body (24) which delimits an expansion volume (28) and houses at least partly the main pipe (12) and the secondary pipe (16), wherein the intake pipe (8) of the exhaust gas is in fluid continuous connection with the main pipe (12) through the secondary pipe (16), and wherein the main pipe (12) comprises, downstream of the fork (10), a throttle valve (32) which allows or prevents a further fluidic connection of the intake pipe (8) of exhaust gas with the main pipe (12), and an output of the exhaust gases (40), for the expulsion of the gases from the muffler pipe (4).

13 Claims, 2 Drawing Sheets

(56) References Cited

U.S. PATENT DOCUMENTS

| | | | | |
|---|---|---|---|---|
| 8,602,158 | B2 * | 12/2013 | Hayama | F01N 13/14 181/227 |
| 8,851,230 | B2 * | 10/2014 | Ono | F01N 1/089 181/227 |
| 9,574,471 | B2 * | 2/2017 | Hayama | F01N 1/089 |
| 9,695,719 | B2 * | 7/2017 | Arai | F01N 1/084 |
| 10,605,133 | B2 * | 3/2020 | Akrapovic | F01N 1/168 |
| 10,823,022 | B2 * | 11/2020 | Soatti | F01N 1/16 |
| 10,890,118 | B2 * | 1/2021 | Miura | F02D 9/04 |
| 11,248,504 | B2 * | 2/2022 | Kishikawa | F01N 1/166 |
| 11,346,270 | B2 * | 5/2022 | Miura | G10K 11/162 |
| 11,846,216 | B2 * | 12/2023 | Ahn | F01N 1/023 |
| 2003/0121720 | A1 * | 7/2003 | Chang | F01N 3/0335 181/254 |
| 2006/0000205 | A1 * | 1/2006 | Bozmoski | F01N 13/011 60/288 |
| 2006/0162995 | A1 * | 7/2006 | Schorn | F01N 1/006 181/254 |
| 2009/0000862 | A1 * | 1/2009 | Buell | F01N 13/1805 181/212 |
| 2010/0146957 | A1 * | 6/2010 | Ambrosino | F01N 1/166 181/254 |
| 2017/0074132 | A1 * | 3/2017 | Nishioka | F01N 1/083 |
| 2018/0238208 | A1 * | 8/2018 | Saxman | F01N 1/165 |
| 2019/0136739 | A1 | 5/2019 | Muramatsu | |
| 2020/0032691 | A1 * | 1/2020 | Miura | F01N 13/1805 |
| 2020/0123947 | A1 | 4/2020 | Muramatsu et al. | |
| 2020/0271042 | A1 * | 8/2020 | Hayama | F01N 3/2842 |
| 2023/0374923 | A1 * | 11/2023 | Huffman | F01N 1/168 |

FOREIGN PATENT DOCUMENTS

| | | | | |
|---|---|---|---|---|
| EP | 2808507 | A2 * | 12/2014 | B62K 11/04 |
| JP | S60157920 | U * | 10/1985 | |
| WO | 2018083650 | A1 | 5/2018 | |

* cited by examiner

MUFFLER FOR INTERNAL COMBUSTION ENGINES

TECHNICAL FIELD

The present invention relates to improvements to mufflers for internal combustion engines, in particular for use in motor vehicles. Embodiments disclosed herein especially relate to mufflers comprising a catalyst device.

BACKGROUND ART

In order to reduce the sound emissions, i.e., the noise caused by the internal combustion engines and by the expulsion of the exhaust gases they produce, the use of mufflers (silencers) is known, wherein the exhaust gases, before being expelled into the atmosphere, pass through pipes that reduce the noise emissions thereof through reflection, i.e. by suitably lengthening the path followed by the exhaust gases, and/or absorption, i.e. by making the exhaust gases, flowing in the muffler, touch sound-absorption material, for example glass wool.

As well known, there are specific regulations in the field of motor vehicles, which set limits for the sound emissions, i.e. the noise caused by the vehicles. These regulations essentially aim to reduce noise pollution especially in urban areas, where the engine usually runs at low speed and limited power. The limits set in the regulations refer to simulated conditions of daily use, when the internal combustion engine is not used at the maximum power.

For this reason, mufflers are known, comprising throttle valves that are operated based on the rotation speed of the engine, in order to block or to allow, at least partially, the passage of the exhaust gases through pipes of appropriate cross sections prior to their expulsion into the atmosphere.

WO2018/083650 discloses a muffler having an intake pipe for the exhaust gases, which separates, at a fork, into a main pipe and a secondary pipe. The main pipe is completely or partially closed by an on-off valve as a function of the number of revolutions of the engine, in such a way that, at low speed, the exhaust gases are forced to pass through the secondary pipe. The main pipe and the secondary pipe are at least partially housed in a muffler body that delimits an expansion volume. The main pipe has a distal end that defines an outlet for the expulsion of the exhaust gases into the atmosphere. At high speed, the valve is open and the exhaust gases flow primarily through the main pipe and only to a minimal extent through the secondary pipe.

The secondary pipe is configured in such a way that the exhaust gases flowing in it cannot exit directly from the secondary pipe towards the front into the atmosphere, but are forced to follow a winding path that connects the secondary pipe and the main pipe inside the expansion volume delimited by the muffler body, which houses the main pipe and the secondary pipe.

The aim of this arrangement is that, when the engine runs at low speed, the low flow rate of exhaust gases flows in the secondary pipe and, downstream thereof, in the main pipe, with a greater reduction in noise emissions. In this way, the muffler is more efficient in reducing noise in conditions of low speed of the engine, i.e. the conditions for which the regulations on noise emissions are more stringent and restrictive. Vice versa, in conditions of high speed and power of the engine, the valve opens and the exhaust gases can flow out with lower resistance and lower pressure drop, mostly through the main pipe. In this case the effect of noise reduction is smaller, but this is not a draw back, since the regulations allow higher levels of noise emissions in conditions of higher speed and power.

The muffler disclosed in WO2018/083650 is very efficient, but has some aspects that can be further improved.

In particular, since the fork subdividing the intake pipe into main pipe and secondary pipe is arranged, for space reasons, close to a catalyst device, when the throttle valve is closed and stops the exhaust gases from flowing in the main pipe, in the catalyst device a condition occurs where the flow speed of the exhaust gases is non-uniform. In particular, the exhaust gases flow through the catalyst device mostly in the inner volume thereof that is arranged opposite the mouth of the secondary pipe, where the pressure drop of the gas flow is lower.

This involves a non-uniform and inefficient use of the catalyst device. Especially when the motor vehicle where the muffler is installed runs at low speed for a long time (typically, long journeys in urban areas), there is essentially a non-uniform wear of the materials inside the catalyst device. The catalyst device should be therefore replaced even if the volume of inner material thereof has been only partially exploited.

As it is well known, the function of the catalyst devices is to decrease the noxious emissions of exhaust gases by facilitating the complete oxidation and reduction thereof. To this end, the catalyst devices have a body, inside which hundreds of small channels are provided, to the walls of which noble metals are applied, for example palladium, platinum and rhodium, which catalyze the oxidation and reduction. These metals are very expensive, and it is therefore important to exploit the inner volume of the catalyst device in an efficient and uniform manner, to avoid a premature replacement thereof.

There is therefore the need for improving the mufflers by at least partially overcoming the draw backs of the prior art mufflers.

SUMMARY

According to an aspect, a muffler for an internal combustion engine is disclosed, comprising an intake pipe for the exhaust gases, which separates, at a fork, into a main pipe and a secondary pipe. The muffler also includes a muffler body, which delimits an expansion volume and at least partially houses the main pipe and the secondary pipe. The secondary pipe has a distal end that is arranged opposite the fork and ends in the expansion volume, and the main pipe has a distal end that is arranged opposite the fork and forms an outlet for the exhaust gases ending outside the expansion volume to expel the exhaust gases outside the muffler body. A throttle valve is provided in the main pipe, arranged preferably downstream of the fork relative to the flow direction of the exhaust gases. The throttle valve is adapted selectively to allow the exhaust gases to enter, or to prevent them from entering, the main pipe based on the number of revolutions of the engine. The muffler also comprises a catalyst device provided in the exhaust gas intake pipe, between the intake port and the fork.

To reduce the draw backs of the prior art mufflers, the main pipe comprises a wall portion, which is arranged between the catalyst device and the throttle valve and is provided with a plurality of inlet holes arranged around an axis of the wall portion. The wall portion is also surrounded by an outer sleeve. The wall portion and the outer sleeve form an annular chamber, which surrounds the wall portion. The annular chamber is fluidly coupled to the main pipe through the inlet holes provided in the wall portion, and to the secondary pipe through at least one passage provided in the outer sleeve. In some embodiments, the annular chamber is fluidly coupled to the secondary pipe through more passages provided in the outer sleeve.

Thanks to this arrangement, in use, when the throttle valve is closed, the exhaust gases flow from the catalyst device into the secondary pipe through the annular chamber. The presence of the annular chamber and the plurality of inlet holes in the wall of the main pipe allows to optimize the flow of exhaust gases in the catalyst device even when the main pipe is closed, or partially closed, by the throttle valve. Thanks to the plurality of inlet holes arranged around the axis of the main pipe, even when the main pipe is closed, or partially closed, the exhaust gases flow through the entire cross section of the catalyst device, instead of passing only in a part thereof.

Essentially, the plurality of inlet holes and the annular chamber, that receives the exhaust gases coming from the inlet holes and conveys them towards the secondary pipe, optimize the flow of the exhaust gases in the catalyst device at low speed, even when the catalyst device is arranged near the fork. Typically, the presence of the inlet holes and the annular chamber, which connects the inlet holes and the secondary pipe, allows a sufficiently uniform flow distribution of the exhaust gases in the catalyst device at low speed even when the exhaust opening of the catalyst device is spaced from the fork by a distance shorter than four times the maximum transverse dimension of the cross section of the useful passage of the catalyst device. In particular, it has been found that the flow of the exhaust gases invests sufficiently uniformly the entire cross section of the catalyst device even if the outlet for the exhaust gases to exit the catalyst device is at a very short distance from the fork, typically a distance equal to, or shorter than, two times the maximum transverse dimension of the passage section of the catalyst device. The circular arrangement of the inlet holes around the axis of the main pipe, downstream of the exhaust opening of the catalyst device, allows to have a sufficiently uniform flow of exhaust gases in the entire cross section of the catalyst device, even if the outlet is spaced from the passage towards the secondary pipe by a distance equal to, or shorter than, for example, the maximum dimension of the cross section of the catalyst device and, in particular, of the exhaust opening of the catalyst device.

In this way, it is possible to provide a muffler equipped with silencer and catalyst device, wherein the exhaust opening of the catalyst device is arranged at a distance from the throttle valve shorter than three times a maximum dimension of the cross section of the catalyst device and preferably shorter than twice the maximum dimension of the cross section, and even more preferably equal to, or shorter than, the maximum dimension of the cross section.

In embodiments described herein, also the distance between the exhaust opening of the catalyst device and the fork, i.e. the intake of the secondary pipe, is equal to, or shorter than, three times, preferably equal to, or shorter than, twice, even more preferably equal to, or shorter than, one time the maximum dimension of the cross section of the catalyst device.

If the catalyst device has a circular cross section, the maximum dimension of the cross section mentioned above corresponds to the diameter. However, the cross section can even be non-circular, for example elliptical. In this case, the maximum transversal dimension corresponds to the major axis of the ellipse.

In embodiments disclosed herein, a connection path is provided inside the muffler body for connecting the secondary pipe and the main pipe, wherein the connection path allows the exhaust gases to flow from the secondary pipe into the main pipe.

In advantageous embodiments, in order to achieve a particularly effective distribution of the flow of exhaust gases in the entire cross section of the catalyst device, the inlet holes are arranged around the axis of the wall portion spaced from one another by an approximately constant distance, or an approximately constant angular pitch.

In order to achieve high efficiency in uniform distribution of the exhaust gas flow, and therefore uniform exploitation of the material inside the catalyst device, the inlet holes are for example configured and arranged in such a way that, in use, when the throttle valve is at least partially closed, the exhaust gases flow through the entire cross section of the catalyst device, preferably with a volumetric flow that is approximately constant at each point of the cross section of the catalyst device. The inlet holes are for example so configured and arranged that, in use, when the throttle valve is closed, the flow of the exhaust gases is approximately constant on the entire useful cross section of the catalyst device.

In some embodiments, the inlet holes are configured in such a way that each of them defines a respective path between the exhaust opening of the catalyst device and the secondary pipe, wherein, in use, the exhaust gases have a pressure drop that is approximately equal in each path.

In some embodiments, each inlet hole has advantageously a cross section with an area that is variable according to the distance between the inlet hole and the passage provided in the outer sleeve, which forms the connection between the annular chamber and the secondary pipe. More in particular, the area of the cross section of the inlet holes increases as the distance between the holes and the passage increases. In this way, for example, the inlet hole closer to the passage connecting the annular chamber and the secondary pipe has a cross section whose area is smaller than that of the adjacent inlet holes. The inlet hole farther from the passage towards the secondary pipe has the maximum cross section.

In this way, the increase in the pressure drop occurring between a specific inlet hole and the passage from the annular chamber to the secondary pipe, caused by the increase in the distance, is balanced by a lower pressure drop concentrated in the cross section of the inlet hole.

The effect of making the speed and flow rate of the exhaust gases in the passage cross section of the catalyst device uniform increases as the number of inlet holes increases. Therefore, at least four, preferably six, and more preferably eight inlet holes can be provided, but a greater number of inlet holes is also possible for making the exhaust gas flow in the catalyst device even more uniform. The number of inlet holes can vary also based on the area of the cross section of the holes. In particular, the smaller the inlet holes, the greater the number thereof. Taking into account that, given the same overall area of the inlet holes, the greater the number of inlet holes (and therefore the smaller the dimension thereof), the higher the pressure drop, to achieve a more uniform flow of the exhaust gases in the cross section of the catalyst device, in some embodiments a limited number of inlet holes may be used, of non-circular shape but having a cross section with a greater dimension in tangential direction.

According to a further aspect, a unit is disclosed having an internal combustion engine and a muffler as defined above. The unit can be in particular a propulsion unit for a motor vehicle.

A further subject of the invention is a motor vehicle, for example and in particular, even if not exclusively, a tilting saddle-riding motor vehicle such as a motor scooter or a motorcycle with two, three or four wheels, comprising an internal combustion engine and a muffler as described above.

BRIEF DESCRIPTION OF THE DRAWING

The invention will be better understood by following the description below and the attached drawing, showing a non-limiting embodiment of the invention. More specifically, in the drawing.

DETAILED DESCRIPTION

Figure 1:
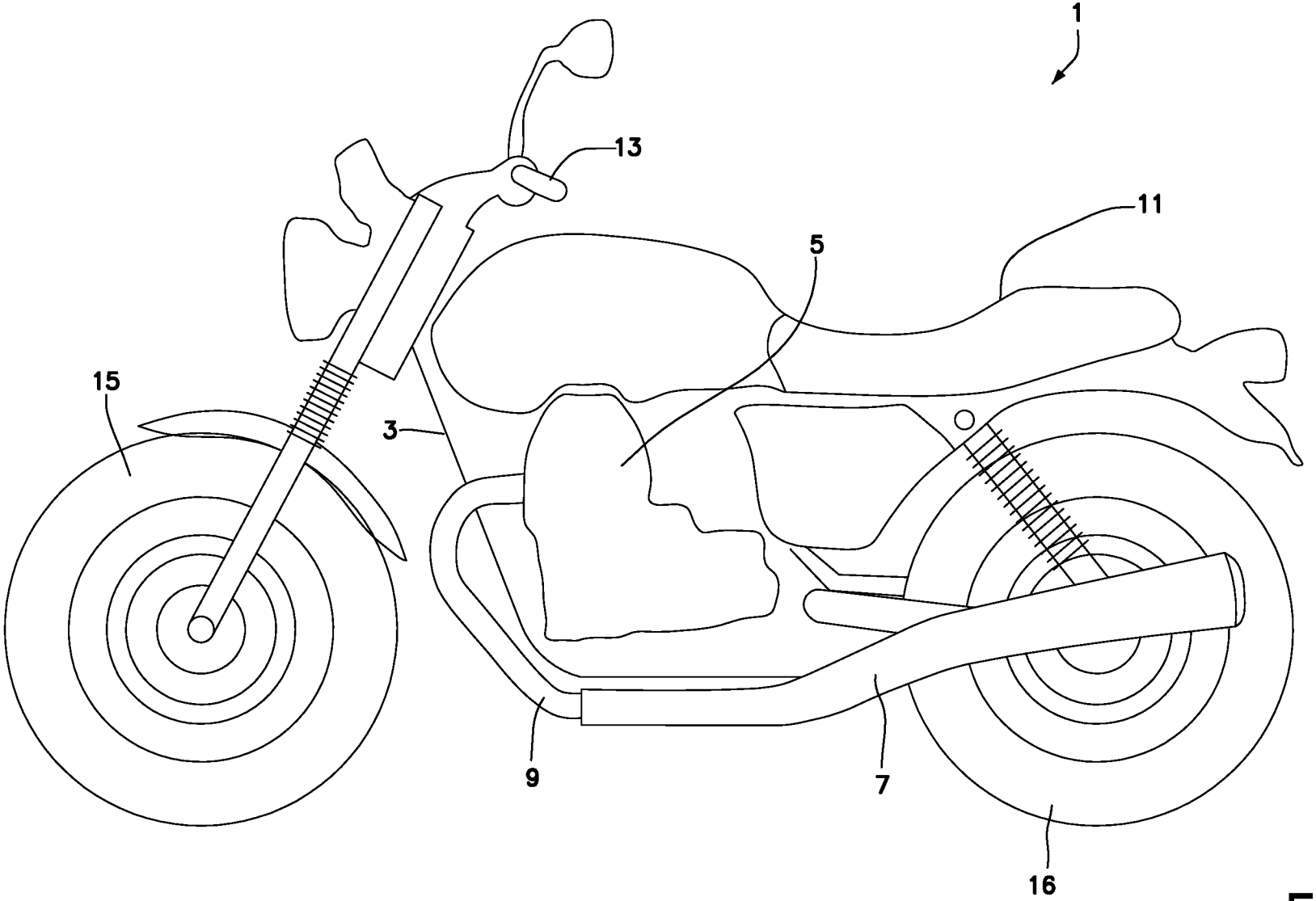
FIG. 1 shows a tilting vehicle, in particular a motorcycle, on which an engine with the muffler of the invention can be installed.

In FIG. 1 a motorcycle 1 is schematically shown, as an exemplary embodiment of a motor vehicle that can use a muffler according to the invention. The motorcycle 1 has a frame 3, on which an internal combustion engine 5 is mounted, the exhaust ports of which are coupled to a muffler 7 through a manifold 9. The saddle of the motorcycle is indicated with the reference number 11, the handlebar with 13, the front steered wheel with 15 and the rear driving wheel with 16. It should be understood that the motor vehicle illustrated herein is only one of the motor vehicles, to the internal combustion engine of which it is possible to connect the muffler 7 of the invention.

Figure 2:
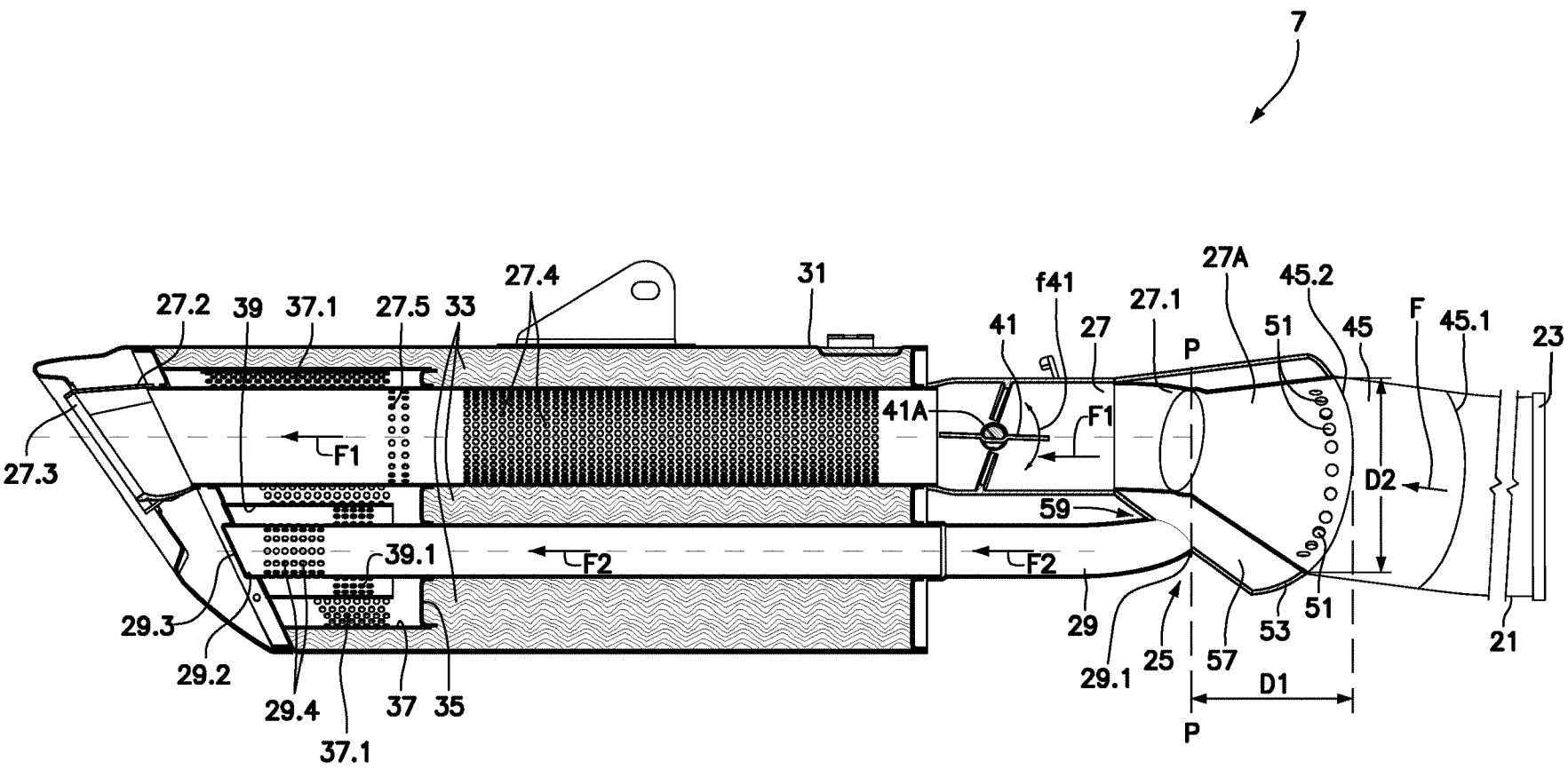
FIG. 2 is a side view and partial longitudinal cross section of the muffler of the invention according to an embodiment.

FIG. 2 is a side view and partial longitudinal cross section of the muffler 7 according to an embodiment. The muffler 7 comprises an intake pipe 21 for the exhaust gases with an intake port 23 for the exhaust gases adapted to be fluidly coupled to the internal combustion engine 5. In the illustrated embodiment, the intake port 23 for the exhaust gases is connected to the manifold 9. The intake pipe 21 for the exhaust gases separates, at a fork 25, into a main pipe 27 and a secondary pipe 29.

The main pipe 27 and the secondary pipe 29 extend inside a muffler body 31, which delimits an expansion volume 33 for the exhaust gases and houses at least partially the main pipe 27 and the secondary pipe 29.

In the embodiment illustrated in FIG. 2, the secondary pipe 29 has a proximal end 29.1 at the fork 25, and a distal end 29.2 that is arranged opposite the fork 25 and ends in the expansion volume 33 formed inside the muffler body 31. In practical embodiments, the distal end 29.1 of the secondary pipe 29 is provided in the expansion volume 33, and therefore in the muffler body 31, so that the secondary pipe 29 is not directly fluidly coupled to the environment outside the muffler body 31. This allows to increase the effect of reducing the noise emissions of the engine, to which the muffler is applied, when the flow of the exhaust gases is forced to pass through the secondary pipe 29 and stopped from passing through the main pipe 27.

To this end, in the illustrated embodiment, at the distal end 29.2 the secondary pipe 29 is closed at the front at 29.3. To allow the exhaust gases to flow from the secondary pipe 29 into the expansion volume 33, at least a part of the tubular wall that defines the secondary pipe 29 has outlet ports 29.4 for the exhaust gases, which fluidly couple the inside of the secondary pipe 29 to the expansion volume 33. In the illustrated embodiment, the outlet ports 29.4 are provided in the portion of the secondary pipe 29 closer to the distal end 29.2 thereof.

The main pipe 27 has a proximal end 27.1, at the fork 25, and a distal end 27.2, opposite the fork. The distal end 27.2 forms an outlet 27.3 for the exhaust gases that ends outside the expansion volume 33 and the muffler body 31, to expel the exhaust gases into the atmosphere.

The main pipe 27 has, in at least one portion thereof extending in the muffler body 31, a plurality of ports 27.4 and 27.5, which fluidly couple the inside of the main pipe 27 to the expansion volume 33.

In the illustrated embodiment, the expansion volume 33 is subdivided into two sub-volumes by an intermediate partition 35. The ports 27.4 fluidly couple the inside of the main pipe 27 to the further upstream sub-volume, and the ports 27.5 fluidly couple the inside of the main pipe 27 to the further downstream sub-volume relative to the flow direction of the exhaust gases, indicated by the arrows F, F1, F2.

Additional components may be provided inside the muffler body 31, for example an approximately cylindrical wall 37, extending around the main pipe 27 and the secondary pipe 29, and a further cylindrical wall 39, extending around the secondary pipe 29. The reference numbers 37.1 and 39.1 indicate communication ports provided through the cylindrical walls 37 and 39, respectively.

The various ports and walls inside the muffler body 31 define a passage for the exhaust gases from the inside of the secondary pipe 29 to the inside of the main pipe 27. It should be understood that the particular structure contained inside the muffler body 31 can vary, even substantially, with respect to that described above. In the illustrated embodiment, a path is provided for the exhaust gases from the inside of the secondary pipe 29 through the ports 29.4, the ports 39.1 and the ports 27.5.

However, the inner structure of the muffler body 31 illustrated herein is given just by way of non-limiting example: namely, the muffler body 31, as well as the components inside it, can have different shapes, always keeping the function of the main pipe 27 and secondary pipe 29, described in greater detail below.

Independently of the particular inner conformation of the muffler body 31, the path provided between the inside of the secondary pipe 29 and the inside of the main pipe 27 allows the exhaust gases, flowing in the secondary pipe 29, to exit through the distal end 27.2.

At least part of the expansion volume 33 defined inside the muffler body 31 is filled with rock wool or other sound-absorbing material, which reduces the noise emissions of the muffler 7 during use.

The muffler 7 further comprises a throttle valve 41 provided in the main pipe 27 and adapted selectively to allow the exhaust gases to enter, or to prevent them from entering, the main pipe 27. In the illustrated embodiment, the throttle valve 41 is so controlled as to rotate around a rotation axis 41A, orthogonal to the plane of FIG. 2, performing a rotation movement according to the double arrow f41 to open and to close the main pipe 27.

The throttle valve 41 is appropriately provided in the main pipe 27 at the fork 25 or downstream thereof.

The throttle valve 41 is controlled in a known manner according to the operating conditions of the engine 5, for example as disclosed in WO2018/083650. In general, just by way of non-limiting example, the throttle valve 41 is opened when the engine 5 exceeds a given number of rpm, and is closed when the number of rpm is low, in order to modify the path of the exhaust gases as described below.

The muffler 1 comprises a catalyst device 45 provided in the intake pipe 21 for the exhaust gases, between the intake port 23 and the fork 25. In general, the catalyst device may have a cylindrical shape, of preferably circular cross section, and has an intake opening 45.1, facing the intake port 23 of the intake pipe 21, and an exhaust opening 45.2, facing the fork 25 and the throttle valve 41.

To make the muffler 7 compact, the catalyst device 45 is provided near the fork 25 and the throttle valve 41. The distance between the exhaust opening 45.2 of the catalyst device and the fork 25 is preferably equal to, or shorter than, three times the diameter of the useful cross section of the catalyst device 45. The useful cross section of the catalyst device 45 is the cross section through which the exhaust gases can pass. If the useful cross section of the catalyst device 45 is not circular in shape, the distance between the exhaust opening 45.2 of the catalyst device 45 and the fork 25 is equal to, or shorter than, three times the maximum dimension of the cross section. For example, if the cross section is elliptical, the maximum dimension corresponds to the major axis of the ellipse. The distance between the exhaust opening 45.2 of the catalyst device 45 and the fork 25 is preferably equal to, or shorter than, two times the maximum dimension of the cross section. In the illustrated example, this distance is shorter than the maximum transversal dimension (i.e. the diameter) of the catalyst device 45.

In the area of the fork 25, between the catalyst device 45 and the throttle valve 41, the main pipe 27 comprises a wall portion 27A provided with a plurality of inlet holes 51 arranged around an axis of the wall portion 27A. In the illustrated embodiment, the wall portion 27A has an approximately truncated-conical shape tapered from an intake end, facing the catalyst device 45, to an outlet end, facing the throttle valve 41.

The wall portion 27A of the main pipe 27 is surrounded by an outer sleeve 53. The wall portion 27A of the main pipe 27 and the outer sleeve 53 form an annular chamber 57 surrounding the wall portion 27A of the main pipe 27.

The annular chamber 57 is fluidly coupled to the main pipe 27 through the inlet holes 51, and to the secondary pipe 29 through at least one passage 59 provided in the outer sleeve 53. Even if in the illustrated embodiment only a passage 59 is provided for fluidly coupling the annular chamber 57 to the secondary pipe 29, however, it is possible to have more passages 59 to fluidly couple the annular chamber 57 to the secondary pipe 29.

As shown in FIG. 2, the passage 59 has a point of minimum distance from the exhaust opening 45.2 of the catalyst device 45. P-P indicates the trace of a plane orthogonal to the axis of the main pipe 27 and passing through the point of the passage 59 that is closer to the exhaust opening 45.2 of the catalyst device 45. DI indicates the distance between the plane P-P and the center of the exhaust opening 45.2 of the catalyst device 45. Practically, the distance DI is the distance between the exhaust opening 45.2 of the catalyst device 45 and the fork 25.

The distance D1 is preferably equal to, or shorter than, three times the maximum dimension D2 of the useful cross section of the catalyst device 45, preferably equal to, or shorter than, two times the maximum dimension D2. In the illustrated example, the distance DI is shorter than the maximum dimension D2 of the cross section of the catalyst device 45.

If the catalyst device 45 has a variable cross section, the size ratios indicated above are to be referred to the useful cross section of the catalyst device.

The size ratios indicated above substantially indicate that the catalyst device 45 is very close to the fork 25, spaced therefrom by such a distance that, if no specific solutions are adopted, when closing the main pipe 27, inside the catalyst device 45 a flow condition would occur, in which the exhaust gases flow only in a portion of the inner volume of the catalyst device, because downstream of the catalyst device there is not a pipe which is sufficiently long to ensure an approximately uniform velocity field in the entire cross section of the catalyst device 45.

To avoid this drawback, that in the prior art devices results in a non-uniform and incomplete exploitation of the material inside the catalyst device, the annular chamber 57 is provided, with the inlet holes 51 that fluidly couple the annular chamber 57 to the main pipe 27 and the catalyst device 45.

The operation of the muffler 7 described above is as follows. When the engine 5 rotates at high speed, i.e. high number of rpm, the throttle valve 41 is open. The exhaust gases flow directly along the main pipe 27 into the muffler body 31 and exit from the outlet 27.3. A minimal part of the exhaust gases can pass through the inlet holes 51 and the annular chamber 57 to flow into the secondary pipe 29 and from here, through the expansion volume 33, into the main pipe 27. Only a minimal portion of the flow of exhaust gases passes through the inlet holes 51, as the pressure drop along this path is significantly sharper than along the main pipe 27.

The velocity field of the exhaust gases through the catalyst device 45 is approximately uniform in the entire cross section thereof.

When the engine 5 rotates at slow speed, i.e. low number of rpm, the throttle valve 41 is closed and the exhaust gases cannot flow through the main pipe 27. Therefore, they flow through the inlet holes 51, the annular chamber 57, the passage 59, the secondary pipe 29, the path between the secondary pipe 29 and the main pipe 27 inside the expansion volume 33, and finally exit through the outlet 27.3.

Between the exhaust opening 45.2 of the catalyst device 45 and the passage 59 towards the secondary pipe 29, the exhaust gases are forced to flow through the plurality of inlet holes 51; as a result, the velocity field of the exhaust gases is approximately uniform through the entire useful cross section of the catalyst device 45, and is not concentrated in the area in front of the passage 59.

This result can be even improved by dimensioning the inlet holes 51 in such a way that the pressure drop occurring when the exhaust gases flow through them is not equal for each hole, but decreases as the distance from the passage 59 increases. The inlet holes 51 that are farther from the passage 59, i.e. farther from the mouth of the secondary pipe 29, can have a cross section greater than that of the inlet holes that are closer to the passage 59, so as to balance the pressure drop caused by the different length of the path between each inlet hole 51 and the passage 59.

The inlet holes 51 are preferably distributed at constant pitch, i.e. spaced from one another by a constant distance on the wall portion 27A, or at constant angular pitch around an axis of the wall portion 27A of the main pipe 27.

Already just three or four inlet holes 51 allow an improvement in the uniformity of the flow of exhaust gases through the catalyst device 45 when the throttle valve 41 is closed. However, by increasing the number of inlet holes 51 it is possible to achieve a greater uniformity of the velocity field of the flow of exhaust gases in the catalyst device. A number of inlet holes 51 equal to, or greater than, six, preferably equal to, or greater than, eight, for example ten or more inlet holes 51, allow a significant improvement of the flow conditions in the catalyst device.

The invention claimed is:

1. A muffler for internal combustion engines, comprising:

an intake pipe for exhaust gases with an intake port for the exhaust gases adapted to be fluidly coupled to an internal combustion engine; wherein the intake pipe for the exhaust gases separates, at a fork, into a main pipe and a secondary pipe;

a muffler body that delimits an expansion volume and houses at least partially the main pipe and the secondary pipe; wherein the secondary pipe has a distal end that is arranged opposite the fork and ends in the expansion volume; and wherein the main pipe has a distal end that is arranged opposite the fork and forms an outlet for the exhaust gases ending outside the expansion volume to expel the exhaust gases;

a throttle valve provided in the main pipe and adapted selectively to allow the exhaust gases to enter, or to prevent them from entering, the main pipe; and a catalyst device provided in the intake pipe for the exhaust gases, between the intake port and the fork; wherein: between the catalyst device and the throttle valve, the main pipe comprises a wall portion, which is provided with a plurality of inlet holes arranged around an axis of the wall portion; the wall portion is surrounded by an outer sleeve; the outer sleeve and the wall portion define an annular chamber surrounding the wall portion; the annular chamber is fluidly coupled to the main pipe through the inlet holes and to the secondary pipe through at least one passage provided in the outer sleeve.

2. The muffler of claim 1, comprising a connection path between the secondary pipe and the main pipe inside the muffler body; wherein the connection path is adapted to allow the exhaust gases to flow from the secondary pipe into the main pipe.

3. The muffler of claim 1, wherein the inlet holes are provided around the axis of the wall portion spaced from one another by a constant distance or a constant angular pitch.

4. The muffler of claim 1, wherein the wall portion has a tapered shape from an intake end facing the catalyst device towards an outlet end facing the throttle valve.

5. The muffler of claim 1, wherein the catalyst device has an intake opening and an exhaust opening for the exhaust gases, and wherein the exhaust opening of the catalyst device is provided at a distance from the throttle valve that is shorter than four times the maximum dimension of the cross section of the catalyst device and preferably shorter than three times the maximum dimension of the cross section of the catalyst device.

6. The muffler of claim 1, wherein the catalyst device has an intake opening and an exhaust opening for the exhaust gases, and wherein the exhaust opening of the catalyst device is provided at a distance from the fork that is shorter than three times the maximum dimension of the cross section of the catalyst device, and preferably shorter than two times the maximum dimension, more preferably equal to, or shorter than, the maximum dimension.

7. The muffler of claim 1, wherein the inlet holes are so configured and arranged that, in use, when the throttle valve is at least partially closed, the exhaust gases flow through the entire cross section of the catalyst device, preferably with a volumetric flow rate that is approximately constant at each point of the cross section of the catalyst device.

8. The muffler of claim 1, wherein the inlet holes are so configured and arranged that, in use, when the throttle valve is closed, the flow of the exhaust gases is approximately constant in the entire useful cross section of the catalyst device.

9. The muffler of claim 1, wherein the inlet holes are so configured that each of them defines a respective path between an exhaust opening of the catalyst device and the secondary pipe, wherein, in use, the exhaust gases are subjected to a pressure drop that is approximately equal in each path.

10. The muffler of claim 1, wherein each inlet hole has a cross section having an area that varies as a function of the distance between the inlet hole and the at least one passage in the outer sleeve that is closer thereto, the area increasing as the distance increases.

11. The muffler of claim 1, comprising at least four, preferably at least six, and more preferably at least eight inlet holes.

12. A motor vehicle comprising an internal combustion engine and a muffler, the muffler fluidly coupled to an exhaust of the internal combustion engine; wherein the muffler comprises:

an intake pipe for exhaust gases with an intake port for the exhaust gases adapted to be fluidly coupled to an internal combustion engine; wherein the intake pipe for the exhaust gases separates, at a fork, into a main pipe and a secondary pipe;

a muffler body that delimits an expansion volume and houses at least partially the main pipe and the secondary pipe; wherein the secondary pipe has a distal end that is arranged opposite the fork and ends in the expansion volume; and wherein the main pipe has a distal end that is arranged opposite the fork and forms an outlet for the exhaust gases ending outside the expansion volume to expel the exhaust gases;

a throttle valve provided in the main pipe and adapted selectively to allow the exhaust gases to enter, or to prevent them from entering, the main pipe; and a catalyst device provided in the intake pipe for the exhaust gases, between the intake port and the fork;

wherein: between the catalyst device and the throttle valve, the main pipe comprises a wall portion, which is provided with a plurality of inlet holes arranged around an axis of the wall portion; the wall portion is surrounded by an outer sleeve; the outer sleeve and the wall portion define an annular chamber surrounding the wall portion; the annular chamber is fluidly coupled to the main pipe through the inlet holes and to the secondary pipe through at least one passage provided in the outer sleeve.

13. The motor vehicle of claim 12, wherein the motor vehicle is a saddle vehicle.

* * * * *